US006086445A

United States Patent [19]

Zawitz

[11] Patent Number: 6,086,445

[45] Date of Patent: Jul. 11, 2000

[54] WRITING DEVICE

[75] Inventor: Richard E. Zawitz, San Francisco, Calif.

[73] Assignee: Tangle, Inc., San Francisco, Calif.

[21] Appl. No.: 09/240,153

[22] Filed: Jan. 29, 1999

Related U.S. Application Data

[60] Provisional application No. 60/073,970, Feb. 6, 1998.

[51] Int. Cl.[7] ..... A63H 13/15; A63H 33/00; B43K 29/00; B43K 7/00; B65H 19/29

[52] U.S. Cl. ..... 446/146; 446/487; 401/209; 401/195; 242/588.1

[58] Field of Search ..... 446/146, 487, 446/486, 383, 102, 104, 99, 97, 71; 401/195, 6, 7, 8, 48, 208, 209; 242/160.1, 588, 588.1, 588.3

[56] References Cited

U.S. PATENT DOCUMENTS

| | | | |
|---|---|---|---|
| 1,069,746 | 8/1913 | Watts | 401/195 X |
| 1,322,966 | 11/1919 | Sinclair | 242/588.1 |
| 2,662,335 | 12/1953 | Calverley | 446/99 X |
| 3,948,455 | 4/1976 | Schwatrz | 242/588.3 X |
| 4,738,558 | 4/1988 | Horimori | 446/487 X |
| 5,897,417 | 4/1999 | Grey | 446/383 X |

*Primary Examiner*—D. Neal Muir
*Attorney, Agent, or Firm*—Townsend and Townsend and Crew LLP

[57] ABSTRACT

The invention provides exemplary writing devices and methods for their use. The writing devices comprise a plurality of segments which are removably coupled to each other. At least some of the segments include a writing mechanism. In this way, the segments may be coupled together in a wide variety of arrangements, with at least one of the writing mechanisms being available for use.

9 Claims, 7 Drawing Sheets

FIG. 13
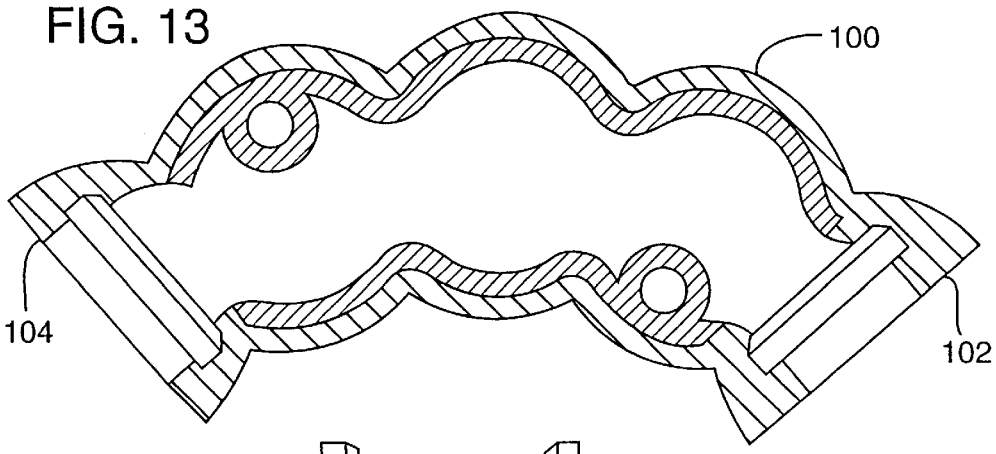
FIG. 15
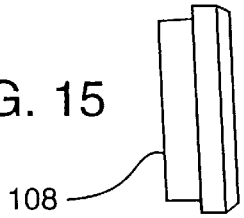
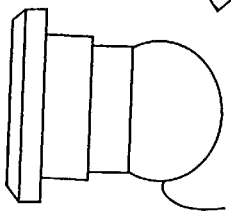
FIG. 14
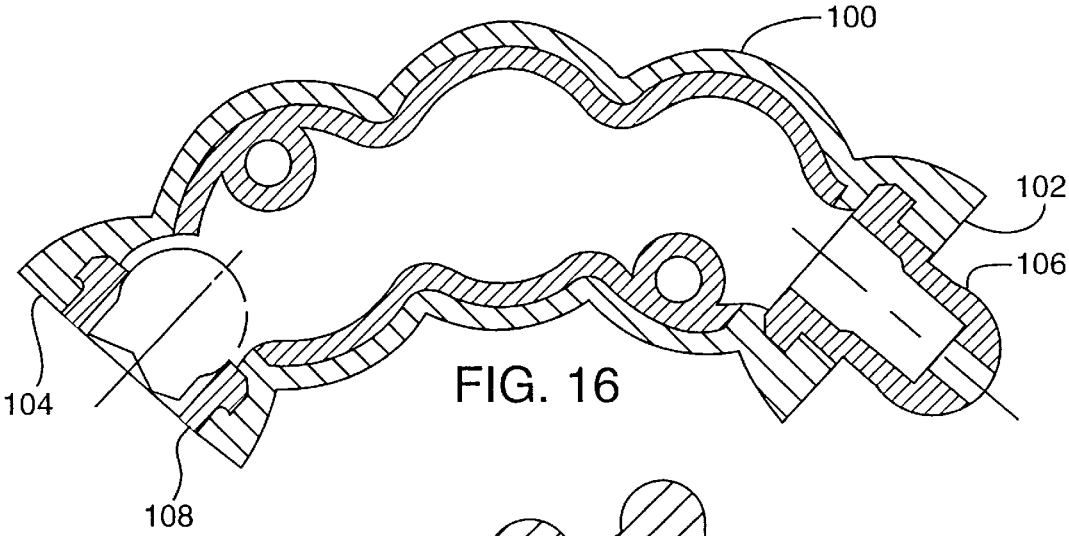
FIG. 16
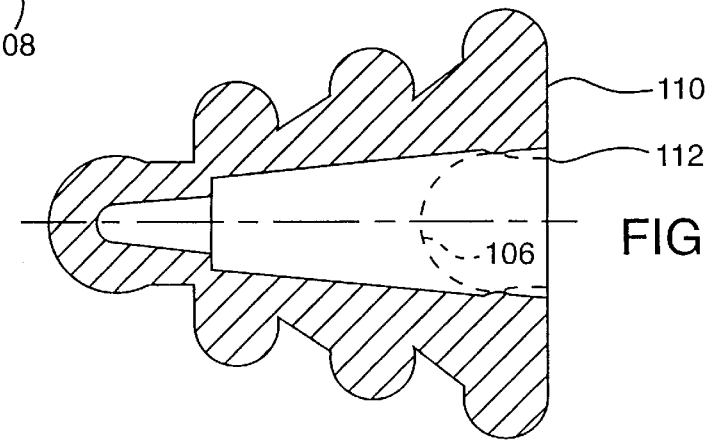
FIG. 17

WRITING DEVICE

CROSS REFERENCE TO RELATED APPLICATIONS

This application is a continuation in part application of and claims the benefit from U.S. Provisional Patent Application Ser. No. 60/073,970, filed Feb. 6, 1998, the complete disclosure of which is herein incorporated by reference.

BACKGROUND OF THE INVENTION

The invention relates generally to the field of toys, and in particular to toys into which a writing mechanism is integrated.

The use of interlocking pieces to form various geometric configurations has been the basis for a variety of toys. For example, LEGO brand building blocks have long been a popular toy. Other interlocking toy sets are described in U.S. Pat. Nos. 4,509,929, 5,110,315, and 5,172,534, the disclosures of which are herein incorporated by reference.

Although such toys have been generally commercially successful, it would be desirable to provide various improvements and diversifying features. Hence, it is an object of the invention to provide various enhancements to a toy system having a set of interlocking pieces.

SUMMARY OF THE INVENTION

The invention provides a variety of writing devices which are constructed of a plurality of interlocking pieces. In one exemplary embodiment, a writing device is provided which comprises a plurality of segments which are removably coupled together in a manner such that each segment is rotatable relative to each other. In this way, a variety of segments may be coupled together and arranged in a wide range of geometric configurations. Further, one or more of the segments includes a writing mechanism to allow a user to produce a visual image by using the writing mechanism.

The writing mechanism preferably comprises a ball point pen, a felt tip pen or the like. In this way, a pen is provided which can have its segments manipulated into a wide variety of geometric configurations.

The segments are preferably interchangeable with each other to increase the number of possible configurations. Conveniently, the segments may be coupled together with a ball and socket arrangement, although other coupling mechanisms can be used, including those described in U.S. Pat. No. 4,509,929, previously incorporated by reference. The ball and socket arrangement is advantageous in that it facilitates receipt of the writing mechanism in the adjacent segment. The segments will preferably frictionally engage each other to allow the segments to remain oriented in a preferred arrangement. To change the arrangement, the segments may be grasped and rotated relative to each other to overcome the frictional force.

The segments may be provided with a wide variety of geometric shapes and will typically be connected in an end-to-end manner. Exemplary geometric shapes include curved segments, straight segments, angled segments, T-segments, Y-segments, and the like. Further, such segment may be provided with a wide variety of surfaces, including textured surfaces, smooth surfaces, colored surfaces, dimpled surfaces, beaded surfaces, ridge and groove surfaces, and the like. One advantage of providing such shapes and surfaces is that a variety of artistic creations may be produced. For example, the segments may comprise various parts of a body, an animal or creature to allow various characters to be created. As such, at least some of the segments may comprise a head to complete the character.

Other features of the writing device include a cap that may be placed over the writing mechanism. The cap also may have a wide variety of shapes and surfaces. One of the segments may also include light that is lighted when a motion sensor detects use of the writing mechanism.

In another embodiment, the invention provides an exemplary holding device which comprises a housing that defines an enclosure which is adapted to receive at least one article. A connector is also coupled to the housing to allow the holding device to be coupled to another modular toy piece or segment.

With the holder of the invention, various articles may be held within the holder and removed when needed. For example, the enclosure within the holder may have a circular periphery so that it can hold a roll of paper. The housing preferably has an opening to allow the paper to be pulled from the housing. In this way, pieces of paper may be dispensed from the holder. Conveniently, the holder may also be coupled to a writing instrument in a manner similar to that described above to allow various notes to be made on the dispensed piece of paper.

Optionally, a lid may be movably coupled to the housing to provide access into the enclosure. In another option, and a clip may be coupled to the lid.

The holder is preferably part of a system of modular toy pieces which includes a plurality of segments which are removably coupled together as described above. In this way, the holding device may be removably coupled to one or more of the segments to allow a wide variety of geometric configurations to be created.

BRIEF DESCRIPTION OF THE DRAWINGS

FIG. 13 is a cross sectional view of an exemplary toy segment according to the invention.

FIG. 14 is a side view of a ball for use with the segment of FIG. 13.

FIG. 15 is a side view of a socket arrangement for use with the segment of FIG. 13.

FIG. 16 illustrates the segment of FIG. 13 having the ball and socket arrangement of FIGS. 14 and 15.

FIG. 17 is a cross sectional view of an exemplary tail according to the invention.

DESCRIPTION OF THE PREFERRED EMBODIMENT

Figure 1:
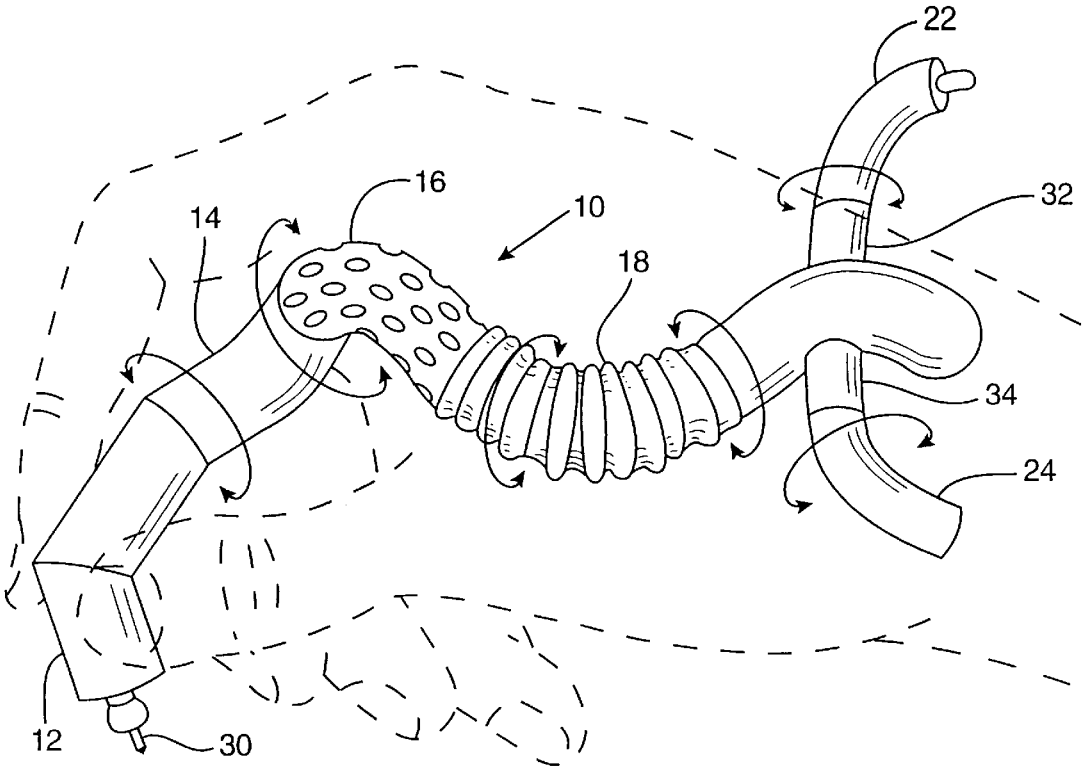
FIG. 1 is a perspective view of an exemplary writing device and its method of use according to the invention.
Figure 3:
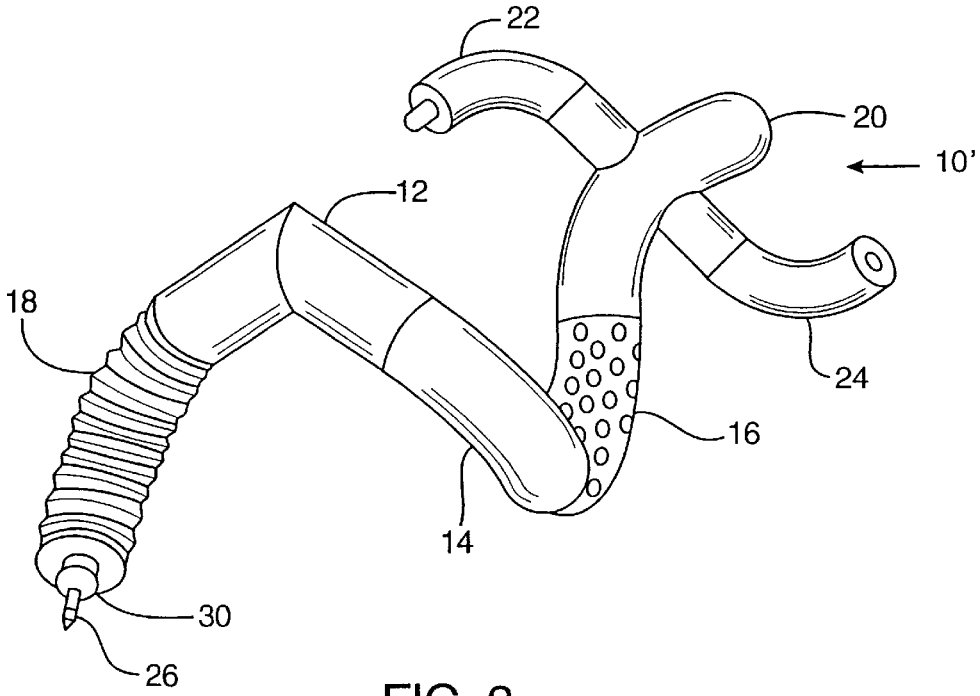
FIG. 3 illustrates the writing device of FIG. 1 having its segments coupled in an alternative arrangement.
Figure 4:
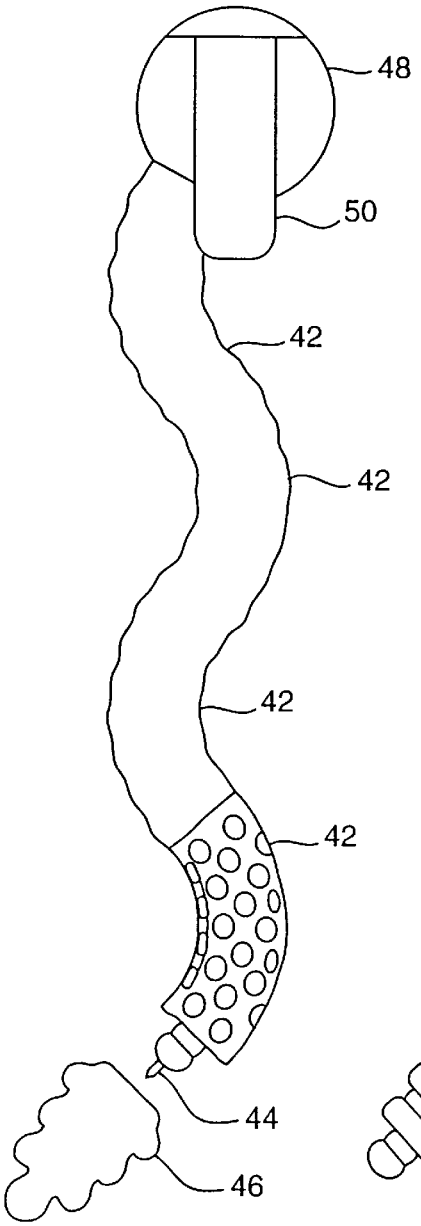
FIGS. 4–12 illustrates alternative embodiments of writing devices according to the invention.
Figure 5:
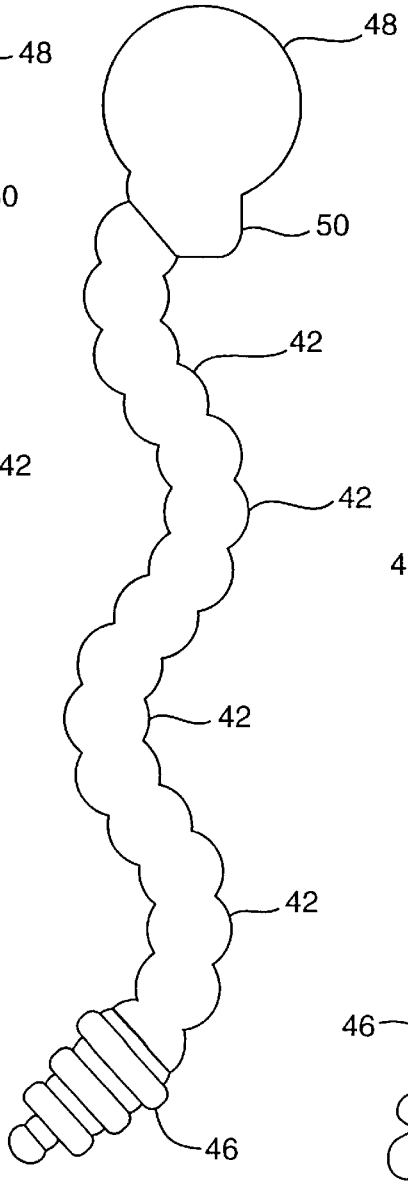
Figure 6:
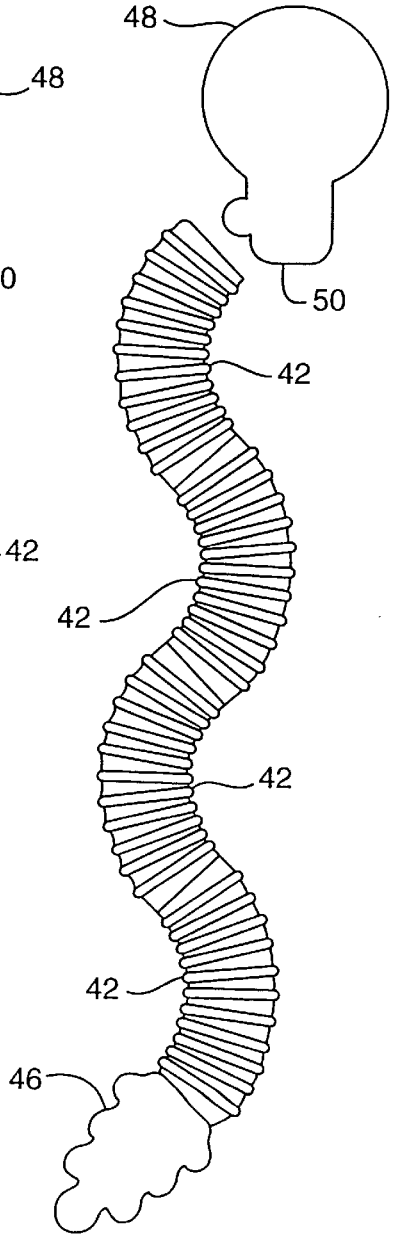
Figure 7:
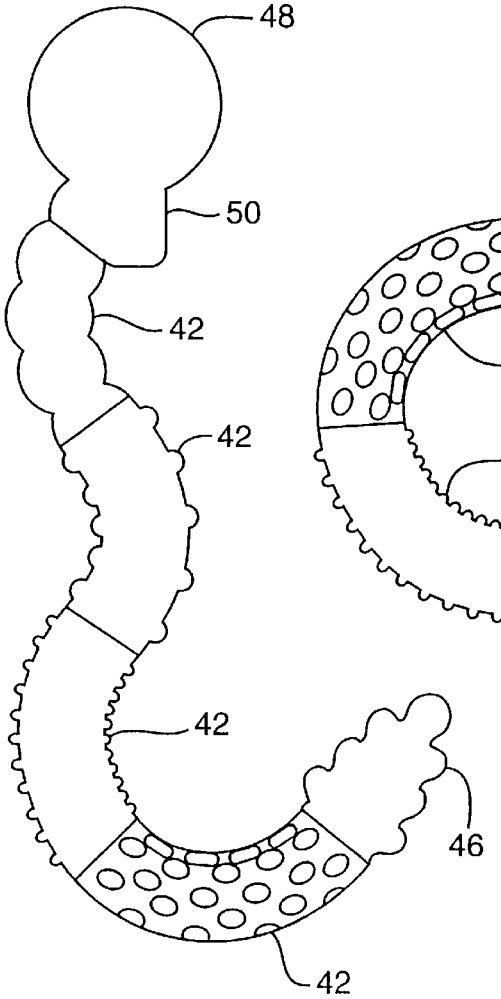
Figure 8:
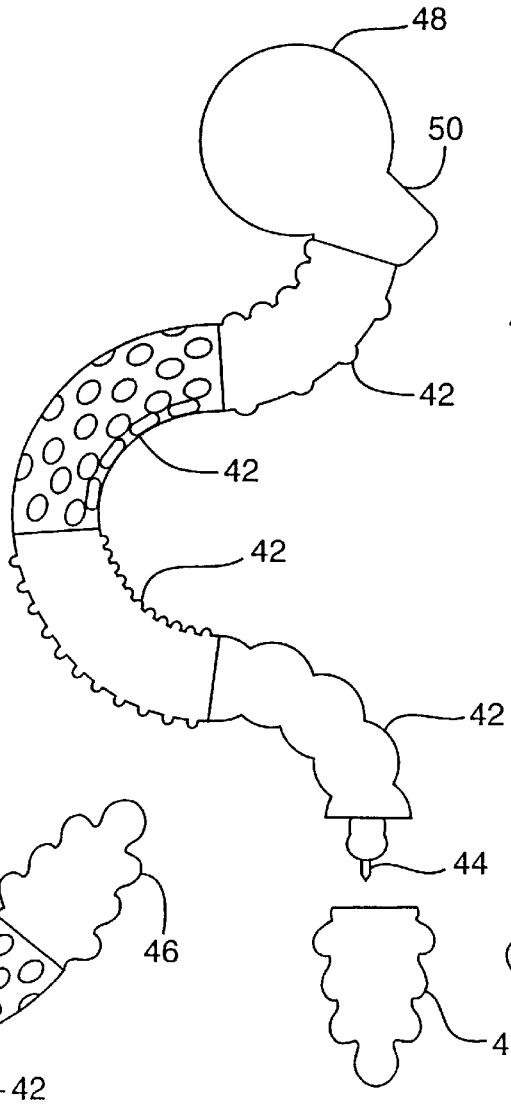
Figure 9:
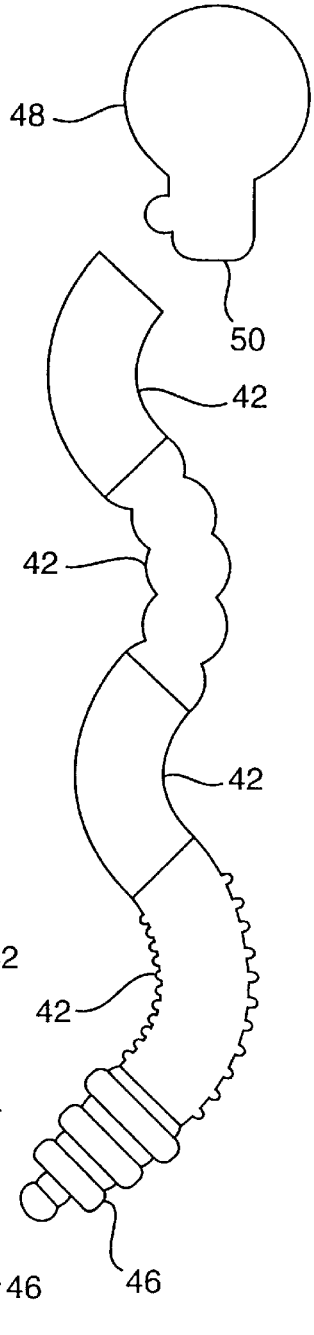
Figure 10:
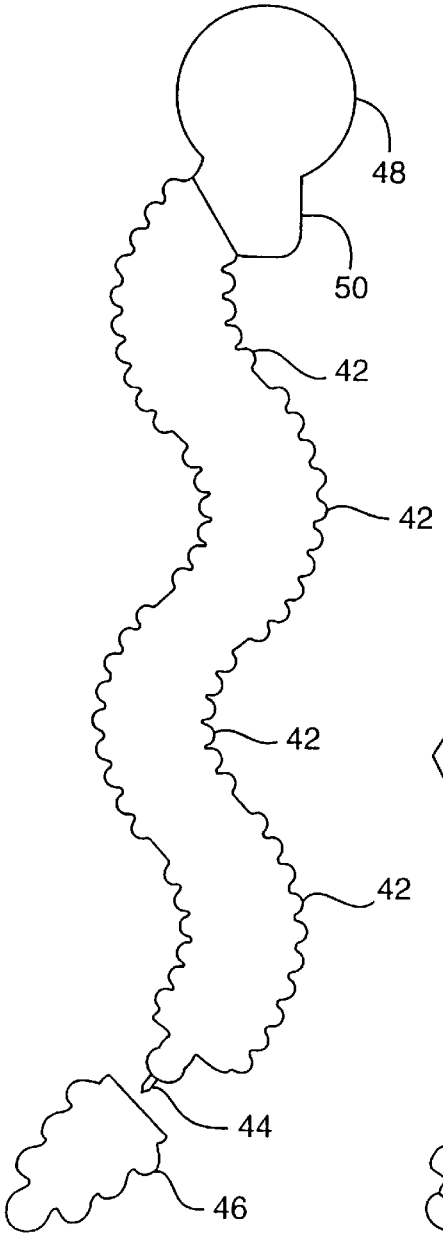
Figure 11:
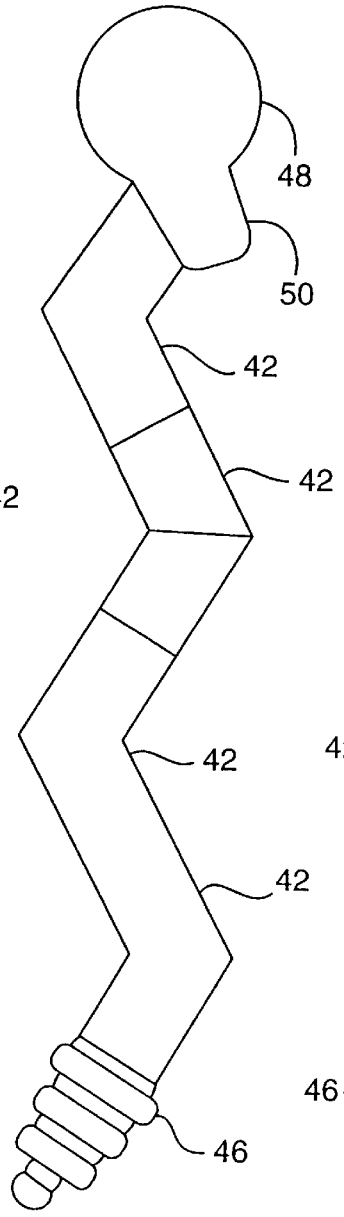
Figure 12:
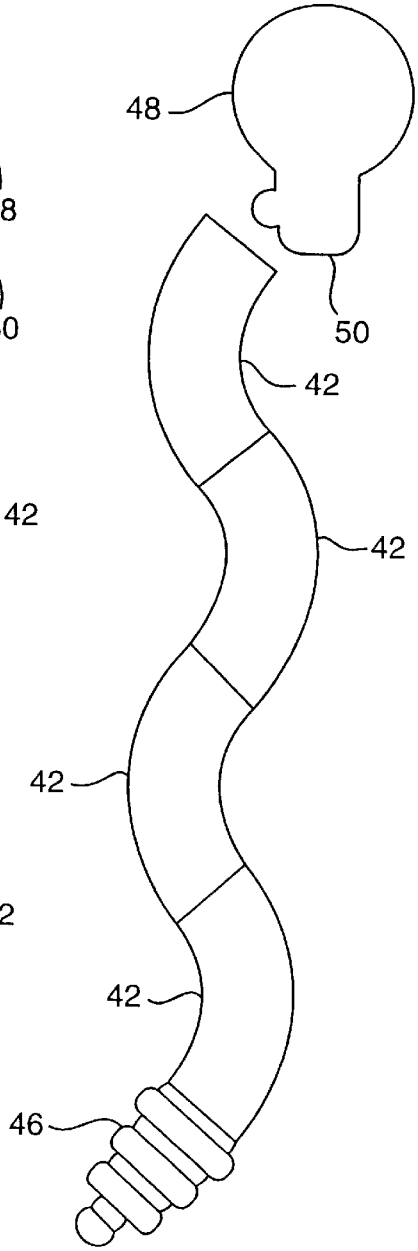

Referring to FIG. 1, an exemplary embodiment of a writing device 10 will be described. Writing device 10 comprises a plurality of segments 12, 14, 16, 18, 20, 22 and 24. Each of segments 12, 14, 16 and 18 are interchangeable with each other to allow device 10 to be configured in a variety of arrangements. For example, FIG. 3 illustrates one alternative arrangement and is referred to by reference numeral 10'. As shown in FIG. 1, each of the segments 12–18 are coupled in an end-to-end manner. Further, the segments are rotatable relative to each other as illustrated by the arrows to increase the number of possible arrangements.

Figure 2A:
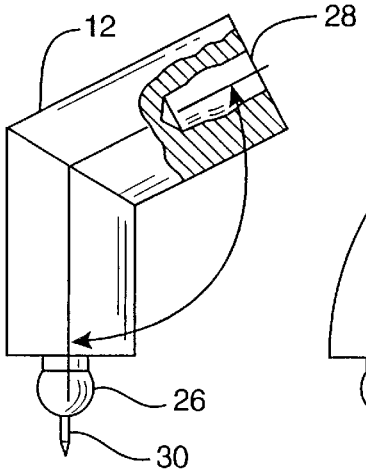
FIGS. 2A–2D illustrates various segments of the writing device of FIG. 1.
Figure 2B:
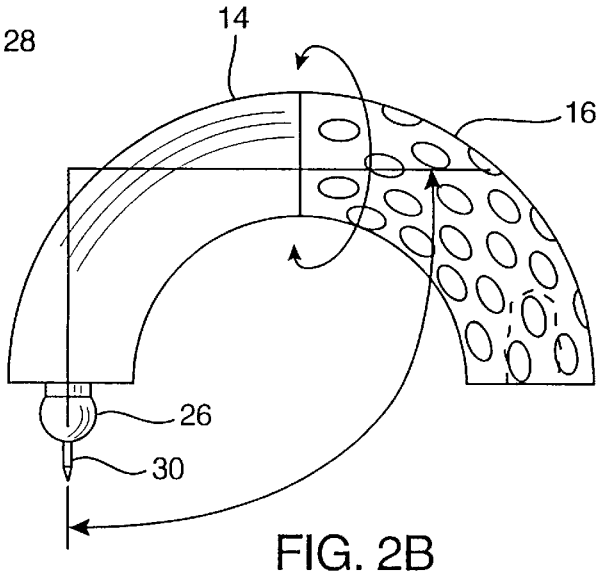
Figure 2C:
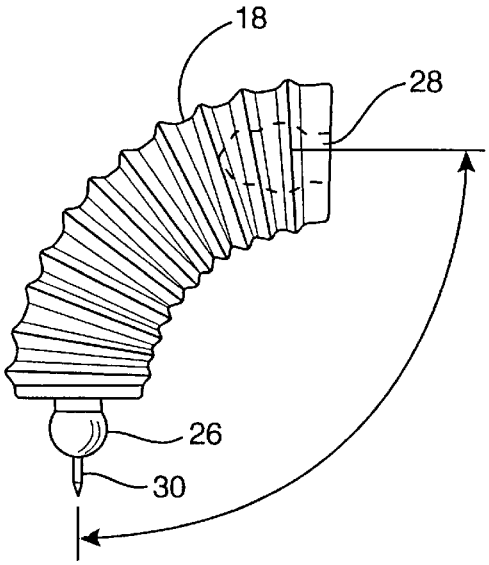
Figure 2D:
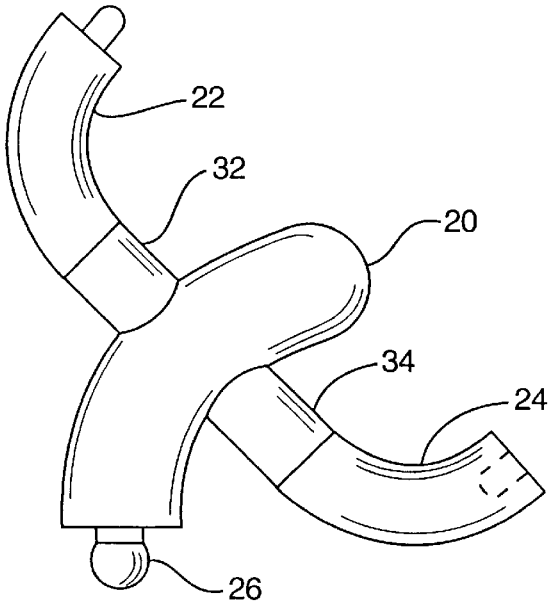

As shown in FIGS. 2A–2C, segments 12–18 each have a ball 26 on one end and a socket 28 on an opposite end. In this way, the segments may be removably coupled to each other by forcing one of the balls into a socket of another segment. The friction between a mating ball and socket will preferably be sufficient to allow two connected segments to remain in a given orientation relative to each other until grasped and rotated by a user. Exemplary materials for constructing the segments include woods, plastics, composites, metals and the like.

Disposed within and extending from balls 26 of segments 12–18 is a writing mechanism 30, such as a ballpoint pen. In this way, regardless of how the pieces are interconnected, at least one writing mechanism will be able to producing a visual image as illustrated in FIG. 1. It will be appreciated that not all of the segments need to include a writing mechanism. For example, segment 20 is an end segment and does not include a pen, although one could be provided. Further, segment 20 conveniently includes a pair of arms 32, 34 to which segments 22, 24, respectively are coupled. In this way, various other segments may be coupled to segments 22 and 24.

As illustrated in FIG. 2A, segment 12 has a smooth surface and is angled at 450, it being appreciated that other angles are possible. Segments 14 and 16 are curved, with segment 16 having a dimpled surface as shown in FIG. 2B. Segments 14 and 16 are curved in an arc having a 90° angle, although other angles are possible. As shown in FIG. 2C, segment is curved and has a ridge and groove surface. It will be appreciated that the geometries and surfaces of each of the segments may be varied to provide a wide assortment of segments. Further, end segment 20 may also be provided with different shapes, surfaces and other connectors. As one example, a light may be included in segment 20 which lights when a user begins writing.

Referring now to FIGS. 4–12, various other embodiments of writing devices will be described. Common to each of these embodiments are a plurality of segments 42 which each include a ball and socket and a writing mechanism 44 similar to device 10. Each of segments may have a wide assortment of geometries and surfaces as shown.

Conveniently, a cap 46 is provided to be received over writing mechanism 44. Cap 46 has a socket to coupled to the ball of the connecting segment 42. As shown, cap 46 is in the shape of a snake tail, although other geometries may be provided. Each device further includes a head 48 having a ball which allows head 48 to be coupled to one of segments 42. Conveniently, head 48 includes a clip 50 to allow the device to be secured to the user's pocket. It will be appreciated that head 48 can include a variety of shapes and configurations, such as character or animal heads, to increase the assortment of available creations.

Referring now to FIG. 13, an exemplary toy segment 100 will be described. Segment 100 is configured to be connected to various other segments in a manner similar to the other embodiments described herein. Segment 100 is constructed of two mating halves (with only one half being shown for convenience of illustration). Each half has two ends 102 and 104. In turn, each end 102 and 104 has an opening so that a ball 106 (see FIG. 14) may be inserted into one of the ends, and a socket arrangement 108 (see FIG. 15) may be inserted into the other end. Such an arrangement is shown in FIG. 16. With ball 106 and socket arrangement 108 in place, the other half of segment 100 is secured in place, using glue or other type of adhesive to form the completed segment.

Shown in FIG. 17 is a cross section of a tail 110 having an opening 112. In this way, tail 110 may be connected to the ball 106 (shown in phantom line) of connector 100.

Figure 18:
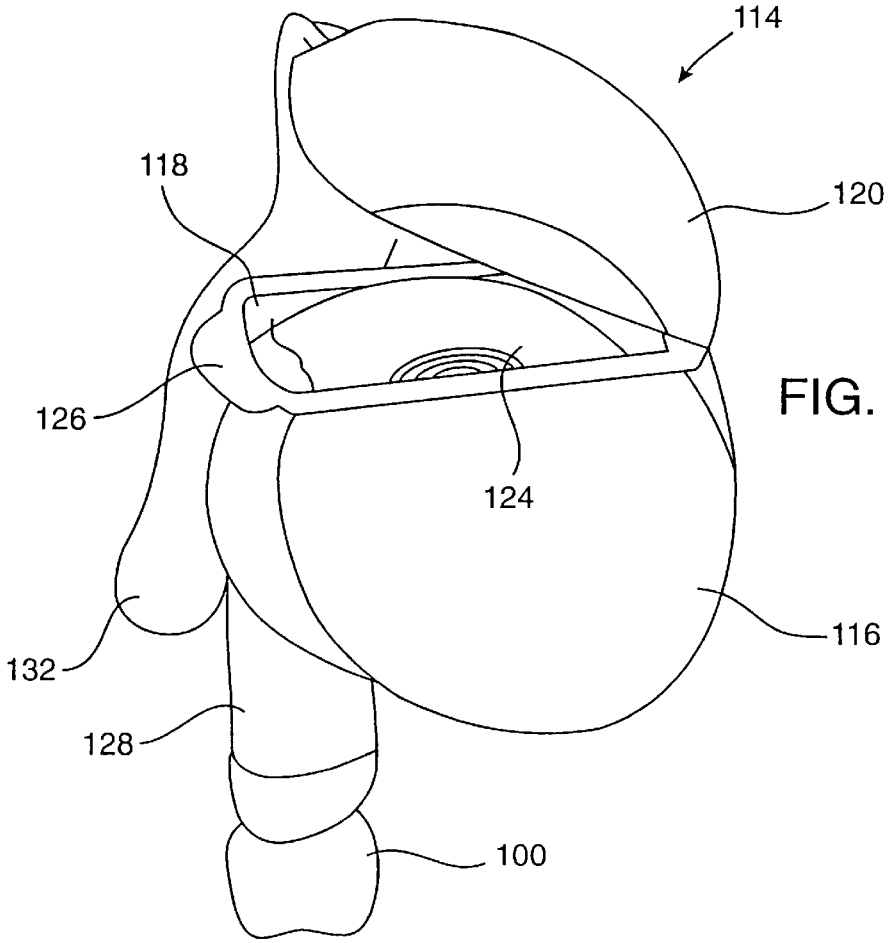
FIG. 18 is a perspective view of an exemplary holding device according to the invention.
Figure 19:
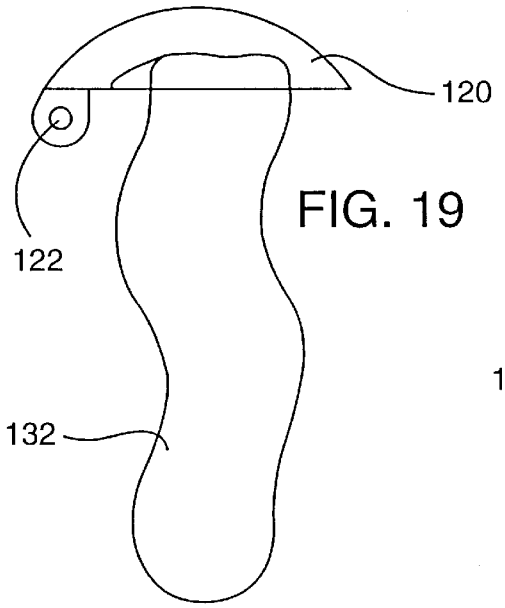
FIG. 19 is a side view of a lid of the holding device of FIG. 18.
Figure 20:
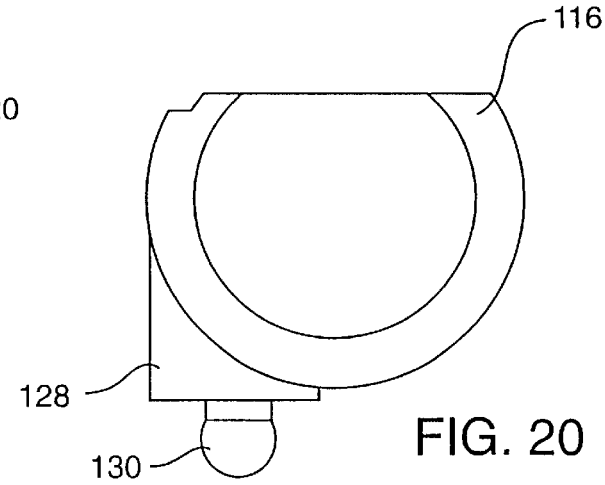
FIG. 20 is a side view of a housing of the holding device of FIG. 18.

Referring now to FIGS. 18–20, an exemplary holding device 114 will be described. Holding device 114 comprises a housing 116 defining an enclosure 118. A lid 120 is pivotally coupled to housing 116 by a pivot pin 122 (see FIG. 19). Conveniently, housing 116 and lid 120 may be constructed from molded plastic. Disposed within housing 116 is a roll of paper 124 which may be dispensing from housing 116 in strips. More specifically, when lid 120 is closed, an opening exists between lid 120 and a lip 126 on housing 116. A user may simply pull the paper from the opening to a desired length. At this point, the user may simply tear or cut the paper to the desired length. Conveniently, lip 126 may be employed to assist in tearing the paper.

As shown in FIG. 20, an extension 128 extends from housing 116 and includes a ball 130 which is similar to ball 106 as previously described. In this way, holding device 114 may be removably coupled to a toy segment, such as segment 100 as shown in FIG. 18. However, it will be appreciated that device 114 may be connected to essentially any type of article or connector which is able to mate with ball 106. Alternatively, a socket arrangement may be included in extension 128 so that device 114 may mate with a ball connector. Further, it will be appreciated that a variety of other connectors may be employed to connect device 114 to another article or device. For example, extension 128 may be configured to sit on top of a conventional pencil, pen, marker, or the like.

Lid 120 also includes a clip 132 which allows holding device 114 to be conveniently clipped to an object, such as a user's pocket. When closed, lid 120 preferably snap fits into housing 116 to provide a secure connection.

Although shown holding roll of paper 124, it will be appreciated that device 114 may be employed to hold a wide variety of articles, including, but not limited to, paper or plastic strips having an adhesive (often referred to as Post-it type notes), serrated paper, paper with messages (such as are found in fortune cookies), food, such as candy, erasers and other stationery supplies, and the like. As such, the shape of housing 116 may be modified according to the article being held.

The invention has now been described in detail. However, it will be appreciated that certain changes and modifications may be made. Therefore, the scope and content of this invention are not limited by the foregoing description. Rather, the scope and content are to be defined by the following claims.

What is claimed is:

1. An assembly of modular toy pieces comprising:

a plurality of modular toy pieces, at least one of which is curved, wherein each toy piece is joined by a rotatable joint to an adjacent toy piece, and wherein at least one of the toy pieces includes a writing instrument;

a holding device comprising a housing having an open top end and defining an enclosure which is adapted to receive a roll of paper when deposited into the enclosure through the open top end as a roll, and a connector coupled to the housing, wherein the connector is coupled to one of the modular toy pieces; and a lid movably coupled to the housing to permit access into the enclosure through the top end when the lid is moved to an open position and to prevent access into the enclosure through the top end when the lid is moved to a closed position.

2. An assembly as in claim 1, further comprising a clip coupled to the lid.

3. An assembly as in claim 1, wherein the enclosure has a generally circular periphery and is adapted to receive a roll of paper.

4. An assembly as in claim 1, wherein the connector comprises a ball connector which is adapted to be inserted into a socket of another modular toy piece.

5. A toy system comprising:

a plurality of segments, at least one of which is curved, wherein each segment is joined by a rotatable joint to an adjacent segment, and wherein at least one of the segments includes a writing instrument a holding device comprising a housing defining an enclosure and an opening to provide access into the enclosure, the holding device further including a connector coupled to the housing, and wherein the connector is coupled to one of the segments;

a roll of paper disposed within the housing such that at least some of the paper is dispensable through the opening, and wherein the opening is sized such that the roll of paper is insertable through the opening as a roll;

a lid movably coupled to a top end of the housing so as to cover the opening when in a closed position and to permit access into the enclosure when the cover is moved to an open position such that the roll of paper is insertable through the open as a roll when the cover is in the open position; and a writing mechanism disposed within and extending from at least one of the segments.

6. A system as in claim 5, wherein the section of paper is formed into a roll.

7. A system as in claim 5, wherein at least some of the segments have a ball at one end and a socket within another end.

8. A toy system comprising:

a holding device comprising a housing defining an enclosure and an opening to provide access into the enclosure, the holding device further including a connector coupled to the housing and a cover to cover the opening;

a plurality of segments which are removably coupled together such that each segment is rotatable relative to an adjacent segment, and wherein the holding device is coupled to a top end of one of the segments such that the holding device is positioned above the segment; and a writing mechanism disposed within and extending from at least one of the segments so that a writing assembly may be constructed with a plurality of segments and the holding device.

9. A system as in claim 8, wherein at least some of the segments are curved in geometry.

* * * * *